United States Patent [19]

Bauer et al.

[11] Patent Number: 4,763,101

[45] **Date of Patent: * Aug. 9, 1988**

[54] LOCKING SLIDE SWITCH

[75] Inventors: Karl-Heinz Bauer, Bad Neustadt/Saale; Gerhard Spiller, Saal a.d. Saale, both of Fed. Rep. of Germany

[73] Assignee: Preh, Elektrofeinmechanische Werke, Jakob Preh, Nachf. GmbH & Co., Bad Neustadt/Saale, Fed. Rep. of Germany

[ * ] Notice: The portion of the term of this patent subsequent to Apr. 21, 2004 has been disclaimed.

[21] Appl. No.: 718,951

[22] Filed: Apr. 2, 1985

[30] Foreign Application Priority Data

| | | | |
|---|---|---|---|
| Apr. 3, 1984 | [DE] | Fed. Rep. of Germany | 3412377 |
| Apr. 3, 1984 | [DE] | Fed. Rep. of Germany | 3412378 |
| Apr. 3, 1984 | [DE] | Fed. Rep. of Germany | 3412379 |
| Jun. 9, 1984 | [DE] | Fed. Rep. of Germany | 3421670 |

[51] Int. Cl.[4] ..... H01C 10/50

[52] U.S. Cl. ..... 338/198; 338/172; 338/200

[58] Field of Search ..... 338/171–173, 338/176, 179, 183, 188, 191–194, 198, 200, 202; 200/157, 159, 321, 327, 328; 38/90

[56] References Cited

U.S. PATENT DOCUMENTS

| | | | |
|---|---|---|---|
| 2,662,317 | 12/1953 | Gomersall et al. | 38/90 |
| 4,455,546 | 6/1984 | Roszel | 200/330 X |
| 4,660,019 | 4/1987 | Bauer et al. | 338/172 X |

*Primary Examiner*—C. L. Albritton

*Attorney, Agent, or Firm*—Woodcock Washburn Kurtz Mackiewicz & Norris

[57] ABSTRACT

A locking slide switch is adapted to set a resistor depending on the length of travel. A key body has a row of teeth with which a pinion meshes. A locking push-button is provided on the shaft of the pinion. In order to make locking from both sides possible, a second pinion or an elongated pinion is guided in the row of teeth. On this pinion is provided a second push-button, which can also be blocked. An on-off switch is additionally provided.

15 Claims, 7 Drawing Sheets

Fig. 5
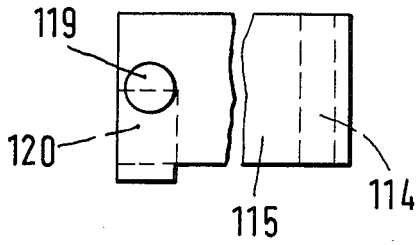
Fig. 6
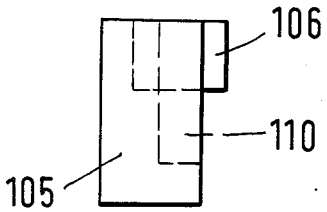
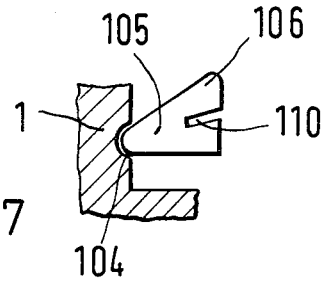
Fig. 7

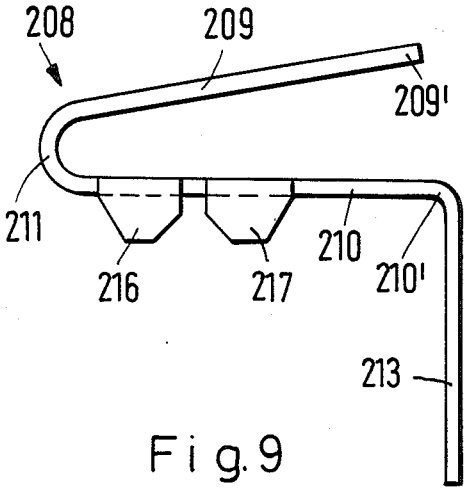
Fig. 9
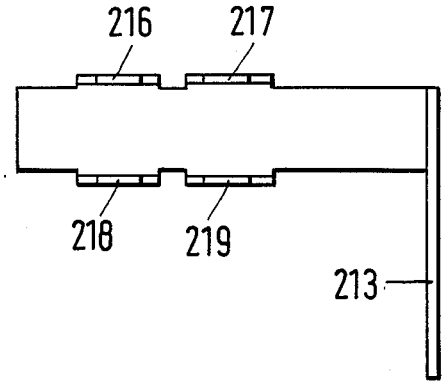
Fig. 10
Fig. 11
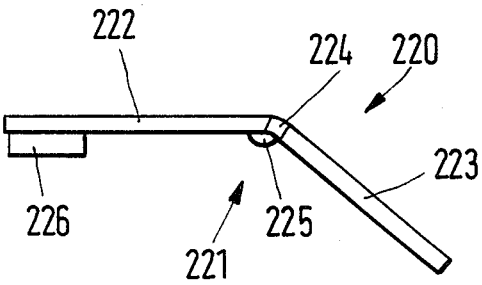
Fig. 12
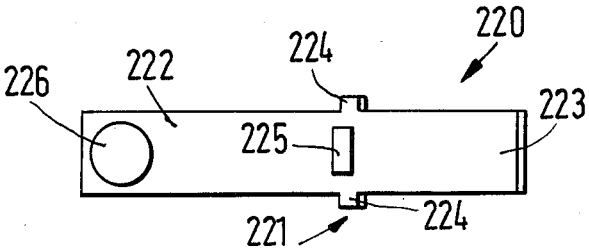

LOCKING SLIDE SWITCH

BACKGROUND OF THE INVENTION

The present invention pertains to a locking slide switch of the type having a key slidable in a switch cover against the force of a spring, at the beginning of whose sliding movement an electrical switching bridge switches, and which adjusts a variable resistor depending on the length of the sliding travel. The key has a row of teeth extending in the longitudinal direction with which meshes a pinion, and a push-button is provided on the shaft of the pinion for locking purposes. The push-button has teeth on its circumference which teeth oppose teeth on one side of the switch cover and the two sets of teeth are caught in each other when meshing with each other under the force of the spring. Such a switch is described in West German Patent Application No. 33 42 474.8. The switch described therein is intended, for example, for installation in the handle of an electrical hand drill. Accordingly, the push-button serving for locking can be reached on one side of the handle. The operation of the push-button is inconvenient in various cases of use. It is desirable that the key can be locked from one side and also from the opposite side of the handle.

The supply terminals must first be connected with a slide in such electrical appliances. The further operation can be controlled by the subsequent sliding or overrun of the slide. For example, the speed of rotation is controlled during overrun in electrical hand drills. The length of travel should be short. In contrast, the overrun should be long in order for the speed of rotation to be finely adjustable. The current supply must be on during the speed adjustment.

SUMMARY OF THE INVENTION

It is an object of the present invention to provide a switch of the type described above, in which the key can be locked both from one side and from the opposite side, and the actuating movement should be equal on both sides.

In accordance with the present invention there is provided a locking slide switch with a key slidable in a switch cover against force of a spring, at the beginning of whose sliding movement an electrical switching bridge switches and which adjusts a variable resistor depending on the length of the sliding travel, wherein the key has a row of teeth extending in the longitudinal direction, which meshes with a pinion, and a first push-button is provided on the shaft of the pinion for locking purposes. The first push-button has teeth on its circumference which oppose teeth on one side of the switch cover, and the two sets of teeth are caught in each other when meshing with each other under the force of a spring. The invention is characterized in that a second push-button is provided on the shaft of the pinion or on the shaft of a second pinion guided in the row of teeth, the second push-button having teeth on its circumference which oppose the teeth on the other side of the switch cover, and these two sets of teeth are caught in each other while meshing with each other under the force of the spring. The key can be fixed over its row of teeth either with the first push-button or with the second push-button and both push-buttons show the same behavior on actuation.

If one of the push-buttons is pressed in any position of the key, the corresponding teeth come to mesh with each other. The pinion is thus no longer able to rotate. When the key is released, the row of teeth pushes the pinion or pinions under the action of the spring, whereby the corresponding teeth are caught. The spring functions not only to reset the key, but also serves to lock the key.

BRIEF DESCRIPTION OF THE DRAWINGS

The present invention is described below in detail based on the following Figures:

FIG. 5 shows a lateral view of the switching bridge shown in FIG. 4;

FIG. 6 shows a lateral view of the catch shown in FIG. 4;

FIG. 7 shows a modification of the catch;

FIG. 9 shows a detailed view of the bow spring shown in FIG. 8;

FIG. 10 shows a top view of the bow spring shown in FIG. 9;

FIG. 11 shows a detailed view of the contact rocker shown in FIG. 8; and FIG. 12 shows a top view of the contact rocker shown in FIG. 11.

DESCRIPTION OF THE PREFERRED EMBODIMENTS

Figure 1:
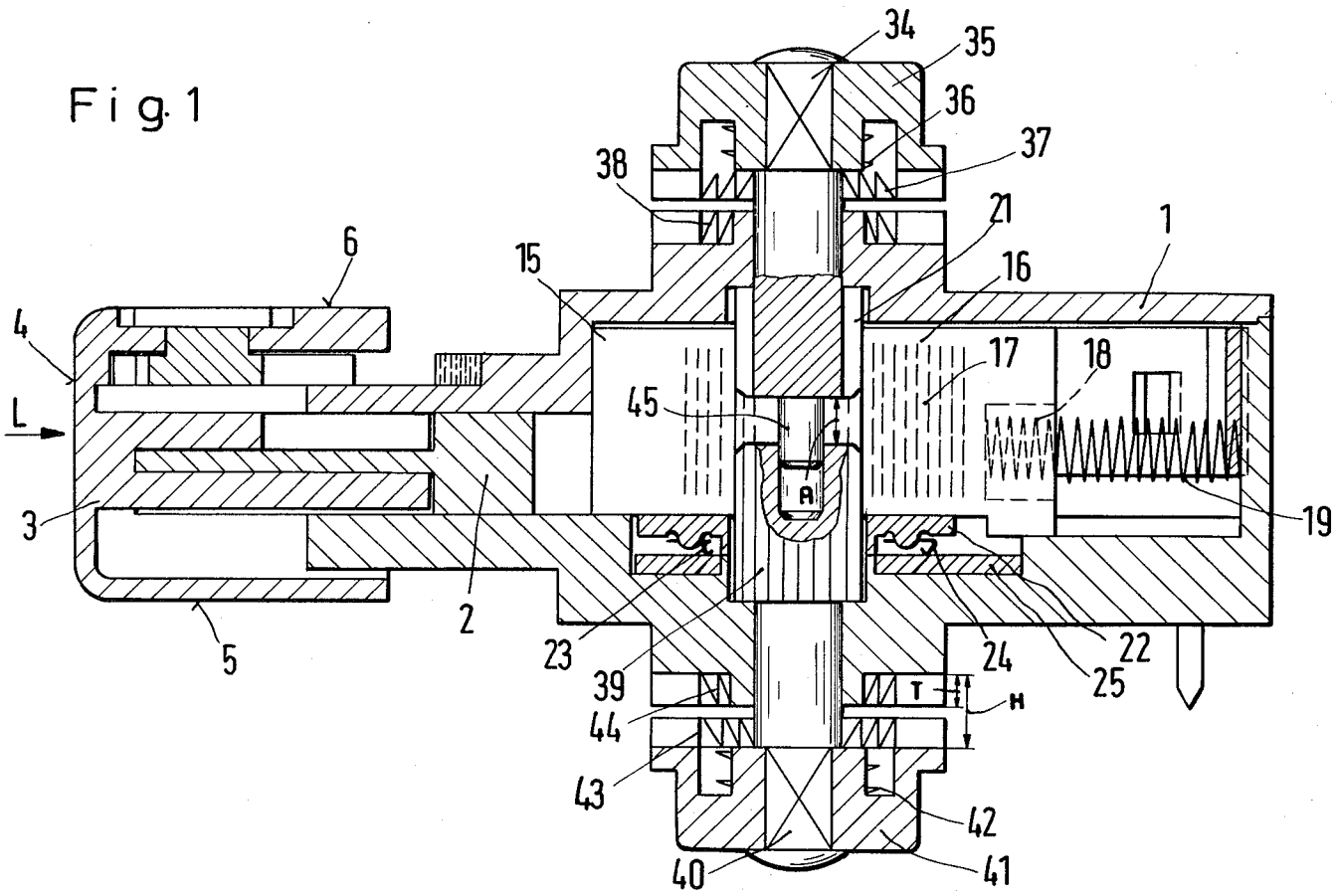
FIG. 1 is a sectional view of the switch in accordance with this invention.
Figure 2:
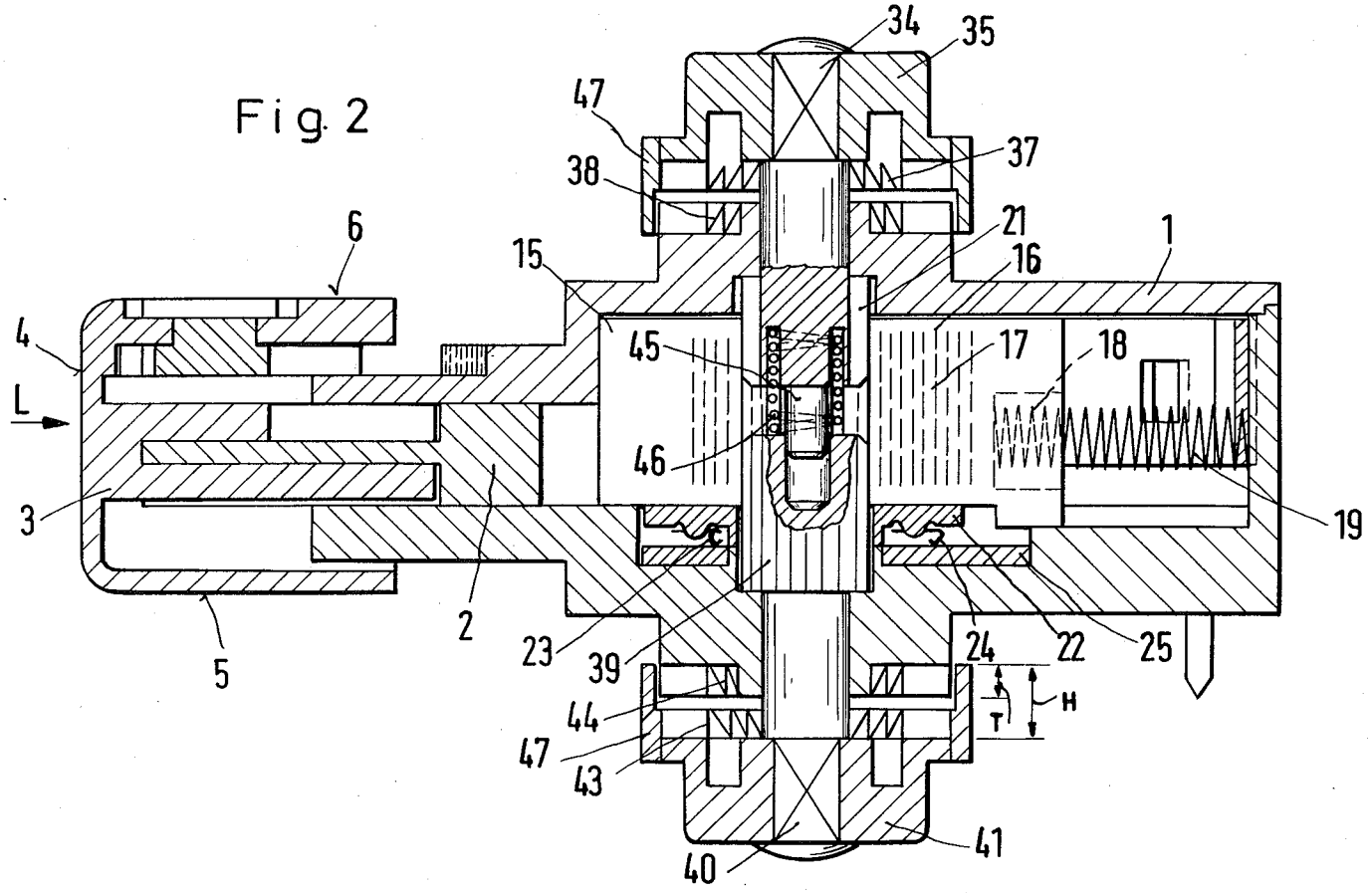
FIG. 2 shows a sectional view of another embodiment of the invention.
Figure 3:
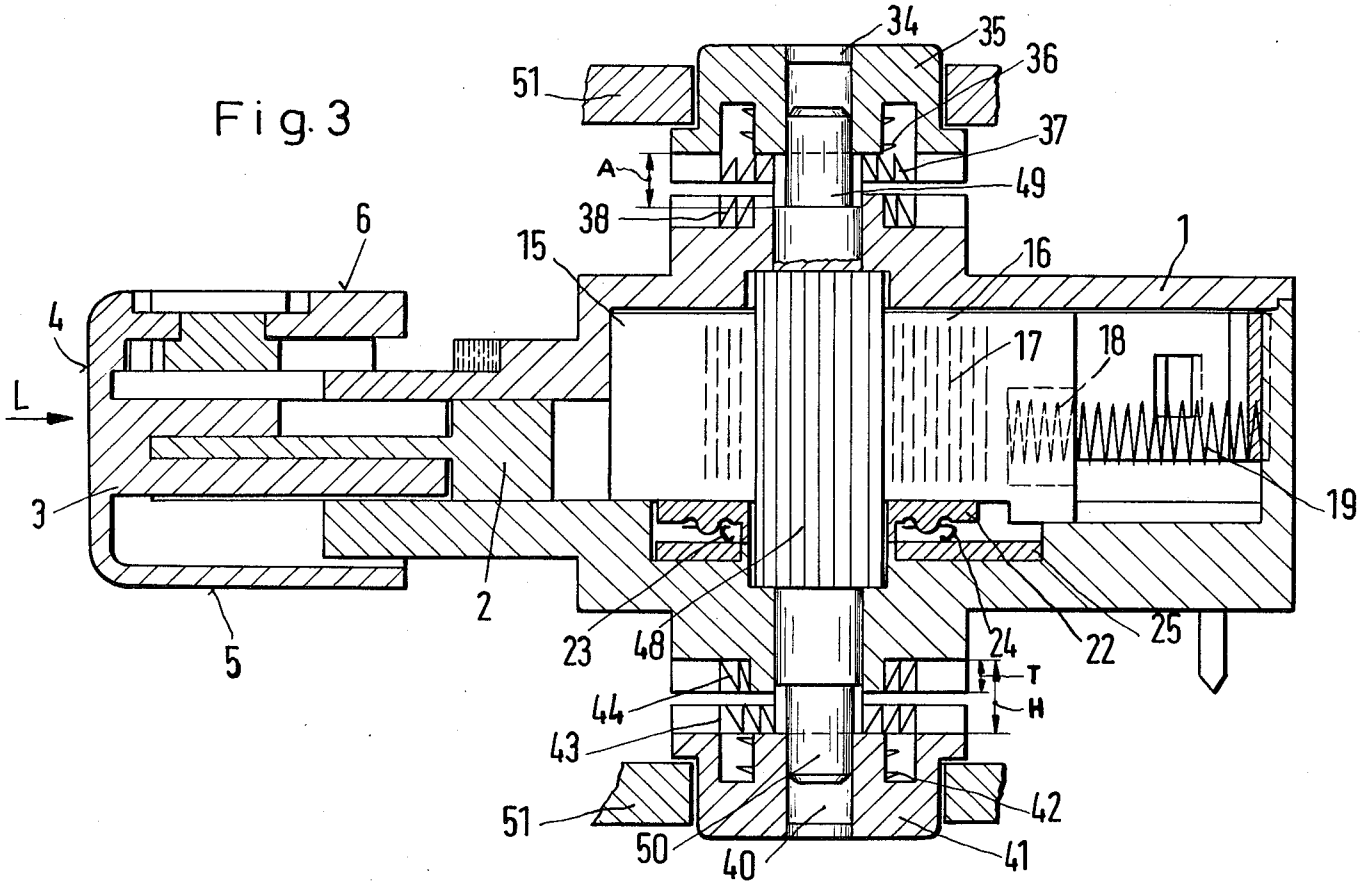
FIG. 3 shows a sectional view of a third embodiment of the invention.

Referring to the embodiments of the invention shown in FIGS. 1–3, a key 2 is mounted for movement in the longitudinal direction L in a switch cover 1. The head 3 of the key is provided with a face 4 and sides 5 and 6. The key 2 has a key body 15, which is guided in the switch cover 1. A cut-out 16 which is provided on one of its sides with a row of teeth 17 which extend in the longitudinal direction L is provided on the key body 15. The row of teeth 17 is above the cutting plane in FIGS. 1–3.

A cavity 18 in which a compression spring 19 is located is provided at the end of the key body 15 opposite from the key head 3. A pinion 21 meshes with the row of teeth 17. A push-button 35 is attached to a square 34 on the shaft of the pinion 21 outside the switch cover 1. The push-button 35 rests via a compression spring 36 on the cover 1. Saw teeth 37 with slightly undercut teeth are provided on the outer circumference of the push-button 35 and corresponding saw teeth 38 are also provided on the switch cover 1.

As shown in FIGS. 1 and 2, the row of teeth 17 meshes with a second pinion 39. A second push-button 41 is attached to a square 40 on the shaft of the pinion 39 outside the switch cover 1. This push-button rests against the cover 1 with another compression spring 42 shown in FIGS. 1 and 3. Saw teeth 43 whose teeth are slightly undercut are provided on the outer circumference of the push-button 41. Matching teeth 44 are provided on the side of the switch cover 1 opposite the teeth 38.

A slide contact carrier 22 which carries the slide contact pins 23 and 24 is mounted on the pinion 39 secured against rotation. These pins contact a printed circuit board. An inner conductor ring is printed on the printed circuit board 25. The slide contact pin 23 contacts the inner conductor ring. There is provided a resistor track in the shape of an arc around the inner conductor ring which track is contacted by the slide contact pin 24.

The pinion 39 is guided for slidable movement on a section 45 on the shaft of the pinion 21. There is a spacing A between the adjacent ends of the pinion 39 and the pinion 21. This spacing A is greater than the depth T of the teeth 37, 38, as well as the teeth 43, 44. On the other hand, the spacing A is smaller than the travel H of the push-buttons 35 and 41. When one of the push-buttons is locked with its teeth, and the other push-button is being pressed, the push-button previously pressed jumps out of its locking position.

The push-buttons 35 and 41 are rotatable with the corresponding pinions 21 and 39, respectively. Consequently, they rotate during displacement of the row of teeth 17. Marks which symbolize the actual setting of the rotary potentiometer formed by the parts 22 through 25 are provided on the outer circumference of the push buttons 35 and 41.

In the embodiment of the invention according to FIG. 2 only one compression spring 46 is provided instead of the two compression springs 36 and 42. This compression spring is located between the two pinions 21 and 39 and pushes them apart. It assumes the function of the compression springs 36 and 42. The push-buttons 35 and 41 are fixed axially on the shafts of the pinions 21 and 39. In addition, FIG. 2 shows a ring jacket 47 provided on the push-buttons 35 and 41, which jacket serves as a dust protector for the saw teeth and for the pinion mount.

In the embodiment shown in FIG. 3 only one pinion 48 is provided instead of the two pinions 21 and 39. The two push-buttons 35 and 41 are mounted non-rotatable but slidable on the axle stubs 49 and 50. The pinion 48 is not slidable in the row of teeth 17 in the direction of its axis. The slide contact carrier 22 is coupled with the pinion 48. In addition, FIG. 3 also shows the position of the wall 51 of the handle.

The mode of operation of the switches described as switches of drills is as follows:

When the key head 3 is being pressed, the drill starts running and the row of teeth 17 rotates the pinions 21 and 39. This causes the slide contact carrier 22 to turn, so that the speed of rotation of the drill increases. If the user wishes to lock the key head 3 during prolonged processing and thus to set the speed of rotation, he presses either the push-button 35 or the push-button 41 against the force of the compression spring 36 or 42, which is weak compared with the compression spring 19 when reaching the desired speed of rotation, FIGS. 1 and 3, or the compression spring 46, FIG. 2, until the teeth 37 and 38 as well as the teeth 43 and 44 mesh with each other. The user then releases the key head 3. This causes the compression spring 19 to press the pinions 21 and 39 via the row of teeth 17 (FIGS. 1 and 2) or the pinion 48 (FIG. 3). Then the compression spring 36 or 42 or 46 is no longer able to separate the matching undercut teeth. The rotary positions of the pinions 21 and 39 (FIGS. 1 and 2) as well as the pinion 48 (FIG. 3) are thus fixed.

If the user wishes to release the locking, he presses the face 4. This causes a slight rotation of the teeth 37 and the push-button 35 or of the teeth 43 of the push-button 41 via the row of teeth 17 and the pinions 21 and 39 or 48 in such a way that the teeth become disengaged from the teeth 38 or 44 under the action of the force of the compression spring 36 or 42 or 46. When pressing the push-button 35 or 41 the corresponding pinion 21 or 39 is also displaced in the row of teeth 17 in the embodiments according to FIGS. 1 and 2. However, the pinion continues to mesh with the row of teeth 17 as shown in FIGS. 1 and 2. The slide contact carrier 22 does not follow this displacement.

It is particularly desirable for the user when operating the switch that he be able to lock either from one side or the other. It is also desirable that the locking, be it via one push-button 35 or via the other push-button 41, can be released by pressing the key head 3. Consequently, the user does not need to check which of the two push buttons, 35 or 41, he had used for locking before to release the locking.

The FIGS. 4–7 show an on-off contact in which the resetting of the contact bridge is not dependent mainly on the prestress of the leaf spring, and the leaf spring is not loaded by the switching current, in which a long overrun is possible with a short switching travel, and which is composed of a small number of parts. To make the contact, the catch is rotated by a short travel of the key body. This causes the leaf spring to be deflected, and it causes the contact bridge to strike the counter-contact. The current flows over the contact bridge. Only a slight turning of the catch is needed to deflect the leaf spring. The length of travel is also shortened accordingly. During the further sliding or overrun of the key body, the position of the catch does not change any longer, so that no additional force needs to be applied to further stress the leaf spring. However, the contacting does not deteriorate between the contact bridge and the counter-contact during the overrun. A long overrun compared with the length of switching travel is possible. When resetting the key body, the body carries the projection of the catch with it during its return function, so that the leaf spring swings back, and the contact bridge separates from the counter-contact. The switch is built essentially of three parts, i.e.,the catch of the leaf spring and the contact bridge. No separate mounting points are needed for the contact bridge and for one of the ends of the leaf spring. The contact bridge holds the leaf spring and the leaf spring forms a restricted guide for the contact bridge. The catch makes separate mounting of the other end of the leaf spring unnecessary.

A roller-shaped catch 105 is mounted on a molded section 104 of the cover 1. This catch has a projection 106, which fits in an opening 107 of the key body 15. In the direction of the arrow L, the opening 107 is bordered upon by a stop 108 formed on the key body 15. Opposite to the stop 108, the opening 107 passes over into an overrun surface 109 provided on the key body 15. The stop 108 juts out of the overrun surface 109.

One end 111 of a leaf spring 112 is inserted into a groove 110 of the catch 105, and fixed. The other end 113 of the leaf spring 112 is swept by a bend 114 of a contact bridge 115. The bend 114 is rotatable in a cavity 116, which is formed between an electrical connection 117 and a web 118 of the cover 1. A contact nub 119 is attached to the end of the contact bridge 115 opposite the bend 114. In addition, a lobe 120 gripping over the leaf spring 112 is formed on the contact bridge 115 opposite the contact 119. The contact bridge 115 is held thereby on the leaf spring 112. The lobe 120 is disposed in a zone in which the leaf spring 112 is greatly deflected. Between the lobe 120 and the bend 114 the leaf spring 112 extends in a preformed spring bow 121. A counter-contact 122 attached to the cover 1 mates with the contact nub 119.

Figure 4:
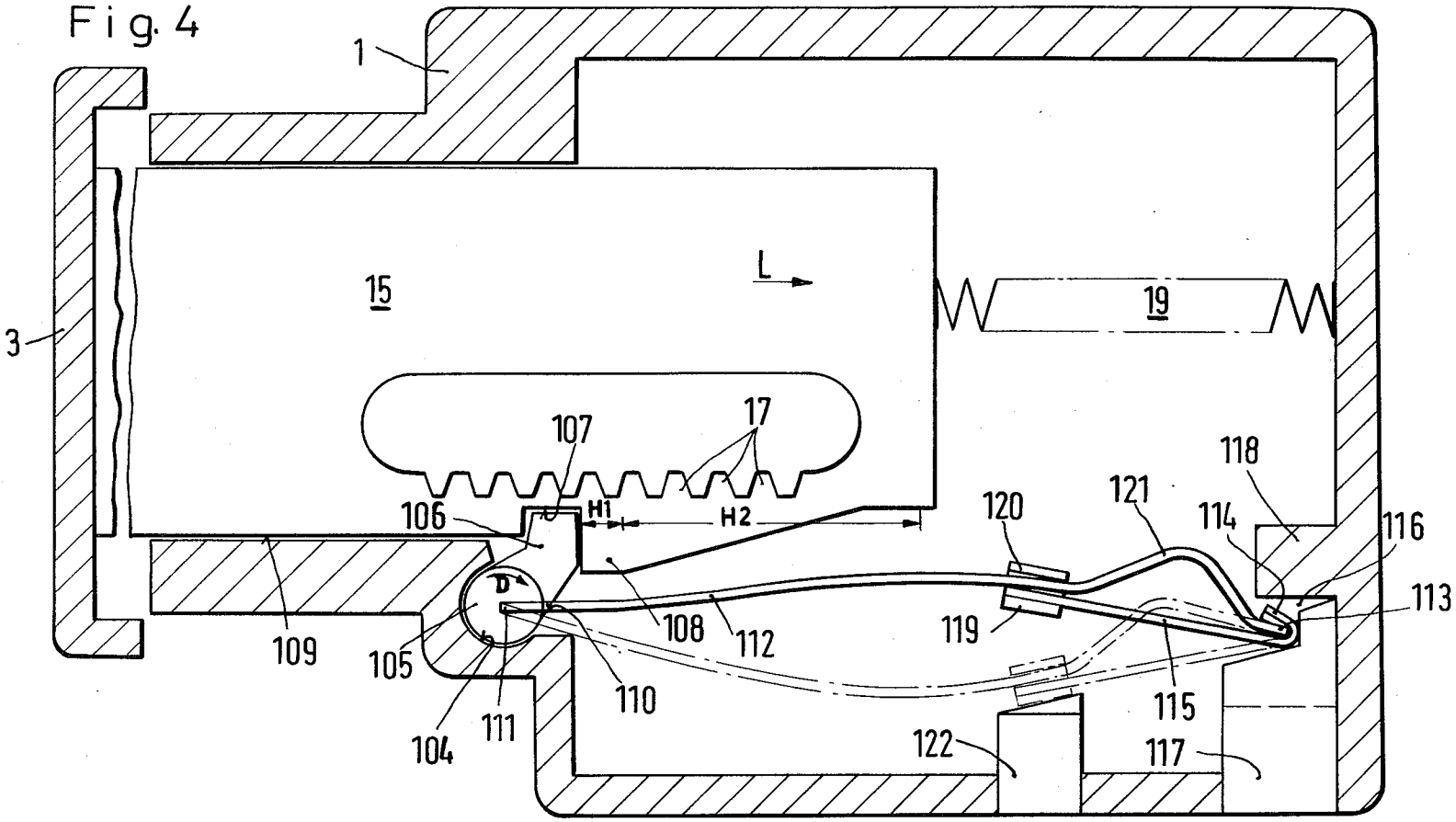
FIG. 4 shows an on-off contact of the switch.

The switch described operates in the following manner:

When the key body 15 is moved from the position shown in FIG. 4 in the direction of the arrow L, the opening 107 carries the projection 106 with it, so that the catch 105 turns in the direction of the arrow D. The leaf spring 112 therefore snaps from its prestressed or home position shown in solid lines in FIG. 4 into the position shown in broken lines. In the process it turns the contact bridge 115 until its contact nub 119 lies against the counter-contact 122. The spring bow 121 guarantees an additional pressing force for the contact nub 119 against the counter-contact 122. This force is also able to compensate for any contact burning which may occur. However, it has been found that the spring bow 121 can be eliminated all together. A flat leaf spring is used in this case. Due to the catch 105 being swung, a wave originating from the catch develops in the leaf spring 112 which wave improves both the making behavior and the breaking behavior of the contacts 119, 122.

The above-described switching process is completed after the switching travel Hl. The projection 106 now lies on the overrun surface 109. It slides on this during further displacement of the key body 15, whereby the contact nub 119 is held at the counter-contact 122. The rotary potentiometer, not shown specifically, is adjusted accordingly during the overrun H2 via the row of teeth 17.

When the key body 15 is released, it is pushed back under the action of the force of the compression spring 19. It then throws the stop 108 against the projection 106, so that the projection is pushed into the opening 107. The catch 105 is turning in the process in the direction opposite the direction of the arrow D, so that the leaf spring 112 snaps back into its home position. Via the lobe 120 it turns the contact bridge 115 whereby the contact nub 119 lifts off from the counter-contact 122 and the contact is open again. Locking of the end position of the key body 15 is insured at the same time by the stop 108 striking the projection 106.

In the embodiment illustrated in FIG. 7, the catch 105 is wedge-shaped rather than roller-shaped. This leads to a substantial reduction of its friction on the cover 1.

Another embodiment of an on-off contact is shown in FIGS. 8–12, in which the contacting does not deteriorate during the overrun, especially during an overrun that is long compared with a short switching travel, and which contact consists of a small number of parts.

At the beginning of the displacement of the key body the contact rocker flips over during the switching travel of the switching pins, so that one of its arms strikes the counter-contact. During the overrun the switching pin slides further on the other arm, and the contact rocker is pressed by the bow spring to the counter-contact, and the bow spring is supported by the surface of the key body sliding by one of its legs. The overrun is preferably long compared with the switching travel. When the key body is released completely, it is returned under the action of the force of a resetting spring. The switching pin flips the switching rocker away from the counter-contact only at the end of the return motion.

A surface 206 parallel to the direction of displacement L is provided on the key body 15. A switching pin 207 is formed at the end of the key body opposite the surface 206. A bow spring 208, FIG. 9, which has a first leg 209 and a second leg 210 reaches between the switching pin 207, FIG. 8, and the surface 206. The two legs 209 and 210 are connected with each other via a spring bow 211, which is located in the zone of the key body 15. The end 209' of the leg 209 facing the back wall 212 of the cover 1 is free. A bend 213 which sits in a guide 214 of the cover 1 is provided at the end 210' of the leg 210 facing the back side 212 of the cover, whereby the bow spring 208 is attached to the cover 1. The bend 213 is connected with an electrical terminal 215.

The leg 210 is provided with lobe pairs turned away from the leg 209 with the lobes 216, 217 as well as 218, 219 being at spaced locations. The switching pin 207 sweeps over the lobes 218 and 219. Between the switching pin 207 and the leg 210 there is located a contact rocker 220, FIG. 11 which consists of two arms 222 and 223 bent away from each other by the angular zone 221. The arms 222 and 223 are, e.g., at an angle of 140° to each other. The bow spring 208 presses the contact rocker 220 against the switching pin 207.

In the angular zone 221 there are provided projections 224 reaching over the contact rocker 220, FIGS. 11 and 12. Each of the two projections 224 reaches between the lobes 216 and 217 as well as 218 and 219 of a pair of lobes, FIG. 8. Within the angular zone 221 there is provided a protuberance 225, FIG. 11. At the free end of the arm 222, FIG. 8, is attached a contact rocker 226, to which belongs a counter-contact 227 fastened to the cover 1.

Figure 8:
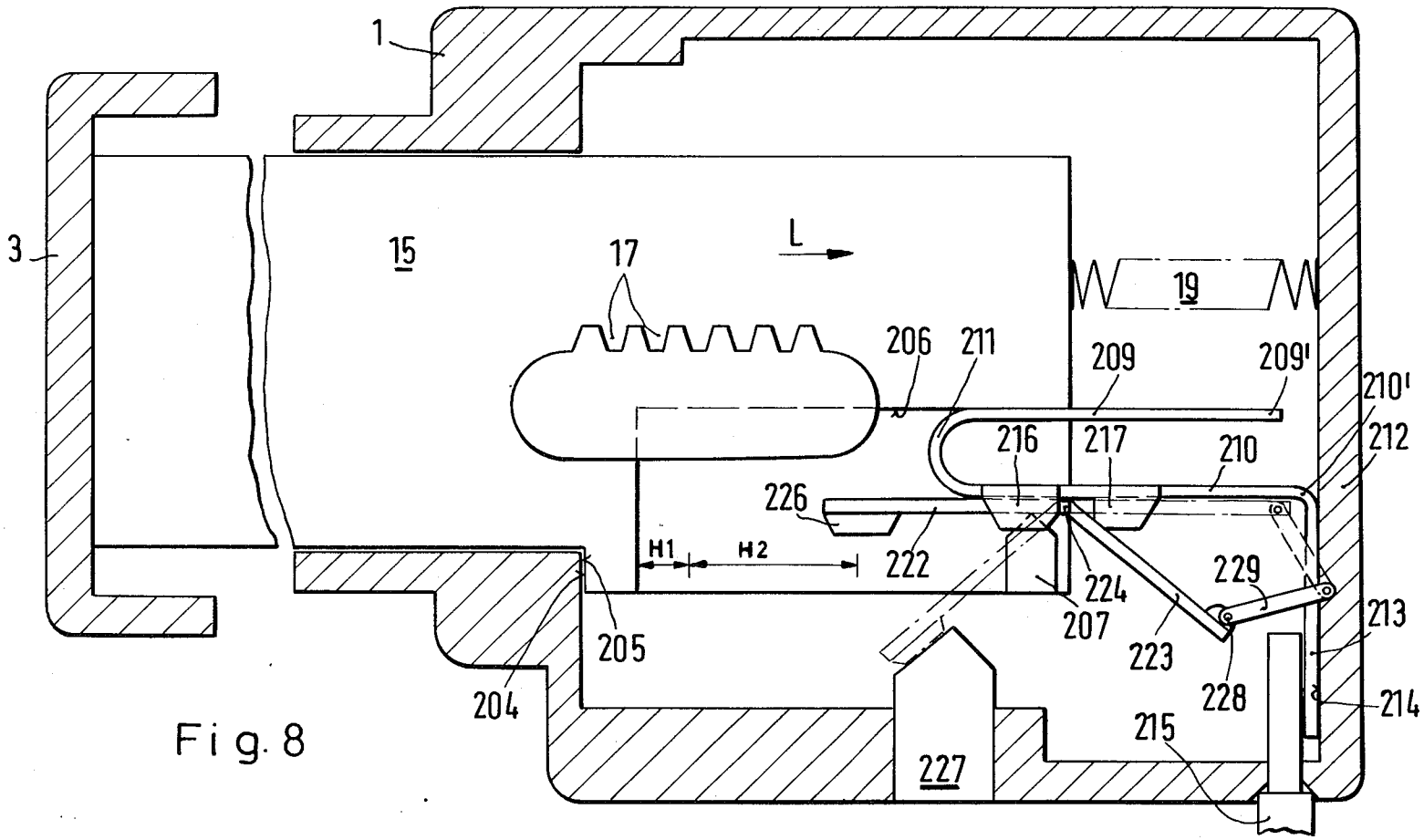
FIG. 8 shows another embodiment of on-off contact of the switch, different from the embodiment shown in FIG. 4.

The arm 223 is at least as long as the overrun H2, FIG. 8. A support 228 each for a catch spring 229 attached to the cover 1 can be provided at its end. However, this catch spring may also be omitted as it only serves to improve the snap-in behavior.

In FIG. 9 the bow spring 208 is shown in its released state. In contrast, it is prestressed between the surface 206 and the contact rocker 220 or the switching pin 207 in FIG. 8.

The mode of operation of the switch described above is as follows:

In the switch position shown in FIG. 8 the contact nub 226 is held lifted off from the counter-contact 227 by means of the switching pin 207 standing on the arm 222. If the key body 15 is moved in the direction indicated by the arrow L, the switching pin 207 comes to lie over the protuberance 225 during the switching travel Hl, thereby pressing the arm 223, which snaps over. This causes the contact nub 226 to tilt over to the counter-contact 227. The arm 223 lies against the leg 210. The electrical contact is now made via the terminal 215, the bend 213, the leg 210, and the contact rocker 220, so that the switch is on.

If the key body 15 is then pushed farther in the overrun zone H2, the rotary potentiometer is adjusted accordingly. During the displacement of the switching pin 207 in the overrun zone H2 the pin is always on the arm 223. The contact nub 226 is pressed increasingly against the counter-contact 227 by the force of the bow spring 208 via arm 223 lying against its leg 210. Safe contact between the contact nub 226 and the counter-contact 227 is consequently always guaranteed in the overrun zone H2.

When the key body 15 is released, it is pushed by the compression spring 19 into its home position. At the end of its return motion the switching pin 207 again comes to lie over the protuberance 225, and comes to lie on the arm 222. This causes the contact nub 226 to be lifted automatically off the counter-contact 227 independent of the action of the bow spring 208. The switch is now opened.

What is claimed is:

1. A locking slide switch with a key slidable in a switch cover against the force of a spring, at the beginning of whose sliding movement an electrical switching bridge switches, and which adjusts a variable resistor depending on the length of the sliding travel, wherein the key has a row of teeth extending in the longitudinal direction, with which meshes pinion means, and a first push-button is provided on the shaft of the pinion means for locking, the first push-button having teeth on its circumference which teeth oppose teeth on one side of the switch cover, and the two sets of teeth are caught in each other when meshing with each other under the force of the spring, characterized in that a second push-button is provided on the shaft of the pinion means guided in the row of teeth, the second push-button means having teeth on its circumference which oppose the teeth of the other side of the switch cover, these two sets of teeth are caught in each other while meshing with each other under the force of the spring and said locking slide switch further comprises means for disengaging the two sets of teeth associated with said first push-button and disengaging the two sets of teeth associated with said second push-button in response to a single actuation of said disengaging means.

2. A locking slide switch in accordance with claim 1, characterized in that the push-buttons are connected non-rotatably with the pinion means.

3. A locking switch in accordance with claims 1 or 2 wherein the pinion means comprises two pinions and the distance between the two pinions is greater than the depth of the teeth on the push-buttons, but smaller than the travel of the push buttons.

4. A locking switch in accordance with claim 1, characterized in that the sets of teeth are provided with slight undercuts and separate from each other upon pressure on the key under the action of a compression spring.

5. A locking slide switch with a key slidable in a switch cover against the force of a spring, at the beginning of whose sliding movement an electrical switching bridge switches, and which adjusts a variable resistor depending on the length of the sliding travel, wherein the key has a row of teeth extending in the longitudinal direction, with which meshes pinion means, and a first push-button is provided on the shaft of the pinion means for locking, the first push-button having teeth on its circumference which teeth oppose teeth on one side of the switch cover, and the two sets of teeth are caught in each other when meshing with each other under the force of the spring, characterized in that a second push-button is provided on the shaft of the pinion means guided in the row of teeth, the second push-button having teeth on its circumference which oppose the teeth of the other side of the switch cover, and these two sets of teeth are caught in each other while meshing with each other under the force of the spring, wherein said key comprises a key body guided in said switch cover, which key body acts upon a leaf spring or which causes a contact bridge to strike a counter-contact during its sliding, wherein the contact bridge switches at the beginning of the sliding motion at a key body travel which is followed by an overrun of the key-body, characterized in that one end of the leaf spring is supported in a bend of the contact bridge and the bend is mounted rotatable on the switch cover, the contact bridge is connected with the leaf spring at a distance from its ends, a catch is attached rotatable on the switch cover to the other end of the lead spring, the catch is provided with a projection by which it can be turned by the key body to deflect the leaf spring whereby the contact bridge strikes the counter-contact or lifts off from the same during the deflection of the leaf spring and the projection is held in its turned position by the key body during the overrun.

6. A slide switch in accordance with claim 5, characterized in that an opening for holding the projection is provided on the key body, and that the opening is bordered on one side in the direction of motion of the key body by an overrun surface and on the other side by a stop of the key body to reset the catch.

7. A slide switch in accordance with claim 6, characterized in that the opening and the projection form an end stop for the key body.

8. A locking slide switch with a key slidable in a switch cover against the force of a spring, at the beginning of whose sliding movement an electrical switching bridge switchee, and which adjusts a variable resistor depending on the length of the sliding travel, wherein the key has a row of teeth extending in the longitudinal direction, with which meshes pinion means, and a first push-button is provided on the shaft of the pinion means for locking, the first push-button having teeth on its circumference which teeth oppose teeth on one side of the switch cover, and the two sets of teeth are caught in each other when meshing with each other under the force of the spring, characterized in that a second push-button is provided on the shaft of the pinion means guided in the row of teeth, the second push-button having teeth on its circumference which oppose the teeth of the other side of the switch cover, and these two sets of teeth are caught in each other while meshing with each other under the force of the spring, wherein said key comprises a key body guided in said switch cover, which key body causes a two-armed contact rocker to strike a counter-contact or to separate from same during its length of travel, one of the arms of the contact rocker being at least as long as an overrun of the key body beyond the length of travel, characterized in that U-shaped bow spring is attached in the cover, the bow spring having legs which extend essentially parallel to the direction of displacement of the key body, and the two arms of the contact rocker are bent against each other in an angular range in which the contact rocker is held tiltable on the other leg of the bow spring and in which the switching pin meshes.

9. A slide switch in accordance with claim 8, characterized in that the switching pin is formed on the key body.

10. A slide switch in accordance with claim 8 characterized in that the bow spring is an electrical connecting contact.

11. A locking slide switch with a key slidable in a switch cover against the force of a spring, at the beginning of whose movement an electrical switching bridge switches, and which adjusts a variable resistor depending on the length of the sliding travel, wherein the key has a row or teeth extending in the longitudinal direction, with which meshes pinion means, and a first push-button is provided on the shaft of the pinion means for locking, the first push-button having teeth on its circumference which teeth oppose teeth on one side of the switch cover, and the two sets of teeth are caught in each other when meshing with each other under the force of the spring, characterized in that a second push-button is provided on the shaft of the pinion means guided in the row of teeth, the second push-button having teeth on its circumference which oppose the teeth on the other side of the switch cover, and these two sets of teeth are caught in each other while meshing with each other under the force of the spring.

12. A locking slide switch in accordance with claim 11, characterized in that the push-buttons are connected non-rotatably with the pinion means.

13. A locking switch in accordance with claim 11 wherein the pinion means comprises two pinions and the distance between the two pinions is greater than the depth of the teeth on the push-buttons, but smaller than the travel of the push-buttons.

14. A locking switch in accordance with claim 12 wherein the pinion means comprises two pinions and the distance between the two pinions is greater than the depth of the teeth on the push-buttons, but smaller than the travel of the push-buttons.

15. A locking slide switch in accordance with claim 1, characterized in that the sets of teeth are provided with slight undercuts and separate from each other upon pressure on the key under the action of a compression spring.

* * * * *